US005454182A

United States Patent [19]

Lewis et al.

[11] Patent Number: 5,454,182

[45] Date of Patent: Oct. 3, 1995

[54] BLACK POWDER FIREARM

[76] Inventors: Alan S. Lewis, 37711 26th St. East, Palmdale, Calif. 93550; John W. Murphy, 6927 E. Grandview Dr., Scottsdale, Ariz. 85254

[21] Appl. No.: 217,979

[22] Filed: Mar. 25, 1994

[51] Int. Cl.[6] ..... F41C 9/08; F41A 19/06; F41A 21/48; F41A 17/74

[52] U.S. Cl. ..... 42/51; 42/69.01; 42/75.01; 42/75.02; 42/70.08

[58] Field of Search ..... 42/41, 51, 65, 42/69.01, 69.03, 75.01, 75.02, 75.03, 76.01, 77, 83, 70.08

[56] References Cited

U.S. PATENT DOCUMENTS

| | | | |
|---|---|---|---|
| 237,357 | 2/1881 | Zundorff | 42/83 |
| 904,646 | 11/1908 | Prinke | 42/18 |
| 2,050,038 | 8/1936 | Browning | 42/17 |
| 2,360,055 | 8/1941 | Hammond | 89/151 |
| 2,455,644 | 12/1948 | Bames | 42/75.08 |
| 3,611,607 | 10/1971 | Donnell | 42/106 |
| 4,158,926 | 6/1979 | Kordas, Jr. et al. | 42/69.01 |
| 4,316,339 | 2/1982 | Herriott | 42/59 |
| 4,519,156 | 5/1985 | Shaw | 42/77 |
| 4,646,457 | 3/1987 | Verney-Carron | 42/41 |
| 4,674,217 | 6/1987 | Matievich | 42/76.01 |
| 4,779,370 | 10/1988 | Cormack | 42/100 |
| 5,133,143 | 7/1992 | Knight | 42/51 |
| 5,274,939 | 1/1994 | Scaramucci et al. | 42/69.03 |

FOREIGN PATENT DOCUMENTS

| | | | |
|---|---|---|---|
| 515710 | 4/1921 | France | 42/75.01 |

*Primary Examiner*—Charles T. Jordan
*Assistant Examiner*—Theresa M. Wesson
*Attorney, Agent, or Firm*—Lowell W. Gresham; Jordan M. Meschkow

[57] ABSTRACT

A black powder firearm (10) is easily disassembled and has interchangeable barrels (12) . Barrels (12) attach to a receiver (24) at a bore (86) in the receiver (24). A lug (50) attaches to the barrel (12) and bolts to the receiver (24) through a hollow lug bolt (46). A bore (98) in the lug bolt (46) holds a ramrod (20) and allows the ramrod (20) to extend into the receiver (24). A breech plug (54) screws into a breech end (16) of the barrel (12). A nipple (58) of the breech plug (54) extends through a hole (88) to engage a hammer (30). A base section (56) of the breech plug (54) abuts a steel portion of the receiver (24). A trigger mechanism (28) has a linear, coil compression hammer spring (102) that is pivotally anchored to a trigger housing (62). This anchor point is displaced from a pivot point for the hammer (30). An anti-blow-back lever (124) engages the hammer (30) when the hammer is in its fired position and a trigger (32) is pulled. The entire trigger mechanism (28) is mounted in the trigger housing 62 so that the entire trigger mechanism (28) may be removed and cleaned as a unit.

34 Claims, 4 Drawing Sheets

BLACK POWDER FIREARM

TECHNICAL FIELD OF THE INVENTION

The present invention relates generally to black powder firearms. More specifically, the present invention relates to black powder firearms which incorporate versatility and ease of use features.

BACKGROUND OF THE INVENTION

Black powder firearms have been around for centuries. Over a century ago the popularity of black powder firearms began to diminish in favor of more modern firearms which used individual cartridges and higher detonation pressures and were generally cleaner and more reliable in varying types of weather. In recent years the popularity of black powder firearms for sport and recreational purposes has increased.

Many inconveniences are still associated with the use of black powder firearms. For example, black powder firearms are more dirty to operate than their modern counterparts. The black powder leaves a heavy, sooty residue which must be continuously cleaned in order to keep the firearm in proper working order. With normal operation, this sooty residue collects through the barrel and the entire ignition system. Unfortunately, conventional black powder firearms are made so that such cleaning is difficult. For example, barrels and ignition system components are difficult to access for cleaning. In addition, their removal is typically considered more appropriately a gun smith operation than a user operation.

Another inconvenience of conventional black powder firearms is their heavy weight and lengthy size when compared to modern firearms. The weight and size characteristics result, at least in part, from the use of long barrels that reside either beside a side-mounted ignition system or a considerable distance in front of an in-line ignition system.

While side-mounted ignition system black powder firearms can have some size advantages, they are undesirable because they are less reliable, have a slow lock time, and are very difficult to keep cleaned.

Conventional in-line ignition models may experience lock time benefits but typically suffer a size penalty because the hammer of the ignition system is placed a relatively long distance from the breech end of the barrel. This placement helps in-line ignition models combat the undesirable phenomenon of blow-back. Blow-back can occur at the instant of ignition when the pressure from the igniting powder forces the hammer back and allows detonation gasses to escape the ignition system. Blow-back is particularly undesirable because blow-back typically occurs in the face of the user, leaving a sooty residue on the face and posing a safety risk.

Another inconvenience of conventional black powder firearms concerns their inflexibility. Typically, different firearm uses require different firearms. For example, when a user needs black powder firearms of different calibers or different barrel rifling characteristics, the user typically is forced to have entirely different firearms to meet each need.

Another problem of conventional black powder firearms concerns their triggering mechanisms. Conventionally, lock times are undesirably slow, and the force required to cock a hammer remains relatively constant or even diminishes as a hammer pivots from a fired position to a cocked position.

This poses a safety hazard because it can lead to unintentional cocking.

Another safety hazard for conventional black powder firearms concerns the mating of a breech plug to the barrel. In some conventional black powder firearms, the breech plug is permanently affixed to the barrel. This is a reasonably safe implementation, but is undesirable because it makes the barrel difficult to clean. In other conventional black powder firearms, the breech plug screws into the barrel and can be removed. This implementation may make some cleaning operations easier, but poses a safety hazard. If the firearm is significantly overcharged, the chances of the breech plug blowing away from the barrel are greater. If this happens, nothing prevents serious harm to the user.

SUMMARY OF THE INVENTION

Accordingly, it is an advantage of the present invention that an improved black powder firearm is provided.

Another advantage of the present invention is that a black powder firearm is provided in which a user may easily remove barrels and ignition system components for cleaning.

Another advantage is that the present invention provides a black powder firearm with interchangeable barrels.

Another advantage is that the present invention provides a black powder firearm with enhanced safety characteristics.

Another advantage is that the present invention provides a black powder firearm which incorporates an in-line ignition system for reliability and ease of cleaning, locates a hammer close to the barrel to reduce the firearm's length, and prevents blow-back.

Another advantage is that the present invention provides a rugged and reliable firearm which can withstand a considerable amount of jostling.

The above and other advantages of the present invention are carried out in one form by a black powder firearm which accommodates a variety of black powder firearm applications while promoting ease of use. The firearm includes a barrel having a lug located a predetermined distance away from a breech end thereof. A mating section of the barrel resides between this lug and the breech end of the barrel. The lug projects radially away from the barrel, and the lug has a hole extending axially therethrough relative to the barrel. A receiver has barrel and stock ends. The receiver also has a first bore therein from its barrel end, and this first bore is configured to engage the mating section of the barrel. The receiver also has a second bore therein from the receiver's barrel end. This second bore aligns with the lug hole when the barrel mates with the receiver. In addition, the receiver has a hollow section between its barrel and stock ends. A trigger mechanism is configured to reside within the hollow section of the receiver and to attach to the receiver. A stock attaches to the receiver at the receiver's stock end.

The above and other advantages of the present invention are carried out in another form by a trigger mechanism for a black powder firearm. The trigger mechanism includes a trigger mechanism housing and a trigger pivotally attached to the housing. In addition, a trigger guard attaches to the housing, and a hammer also pivotally attaches to the housing. A device for removably attaching the housing, trigger, hammer, and trigger guard as a unit to the black powder firearm couples to the housing.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
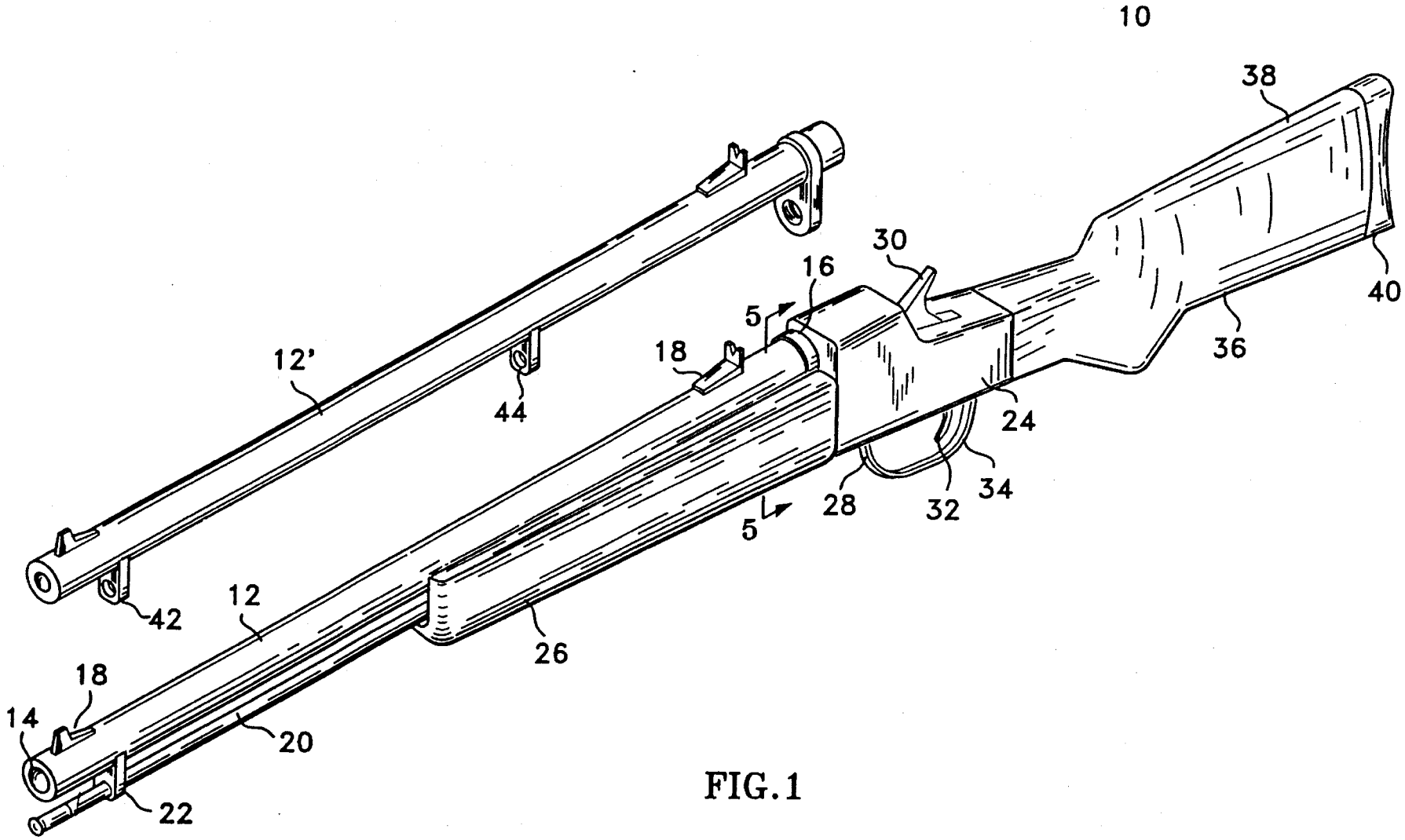
FIG. 1 shows a perspective view of a black powder firearm configured in accordance with the teaching of the present invention.

FIG. 1 shows a perspective view of a black powder firearm 10 configured as a rifle. Firearm 10 includes a barrel 12 having a muzzle end 14 and a breech end 16. Desirably sight components 18, such as a post and "V" are mounted on barrel 12, and a ramrod 20 fits within a carrier 22 underneath barrel 12. Breech end 16 of barrel 12 mates with a receiver 24, and a forearm section 26 attaches to barrel 12 adjacent to receiver 24. A trigger mechanism 28, of which a hammer 30, a trigger 32 and a trigger guard 34 may be seen in FIG. 1, resides within receiver 24. A stock 36 attaches to receiver 24, and a butt end 38 of stock 36 may have a shoulder pad 40 installed thereon.

As discussed in more detail below, firearm 10 may be easily disassembled by the user. This disassembly may take place in the field, or at least away from a gun smith's shop, using only modest tools. This feature makes firearm 10 easy to use by easing the cleaning process.

In addition, this easy disassembly feature extends to the removal of barrel 12 from receiver 24. Consequently, firearm 10 supports a variety of field-interchangeable barrels 12, including barrel 12' shown in FIG. 1. Barrels 12 and 12' include many similar features. However, barrels 12, 12', and others desirably differ in caliber, length, rifling, and the like so that firearm 10 can be easily adapted into a variety of different black powder weapons that accommodate a variety of black powder firearm applications. With sight components 18 mounted on barrel 12 or 12', re-sighting of firearm 10 is not required when barrels 12 or 12' are interchanged.

Figure 2:
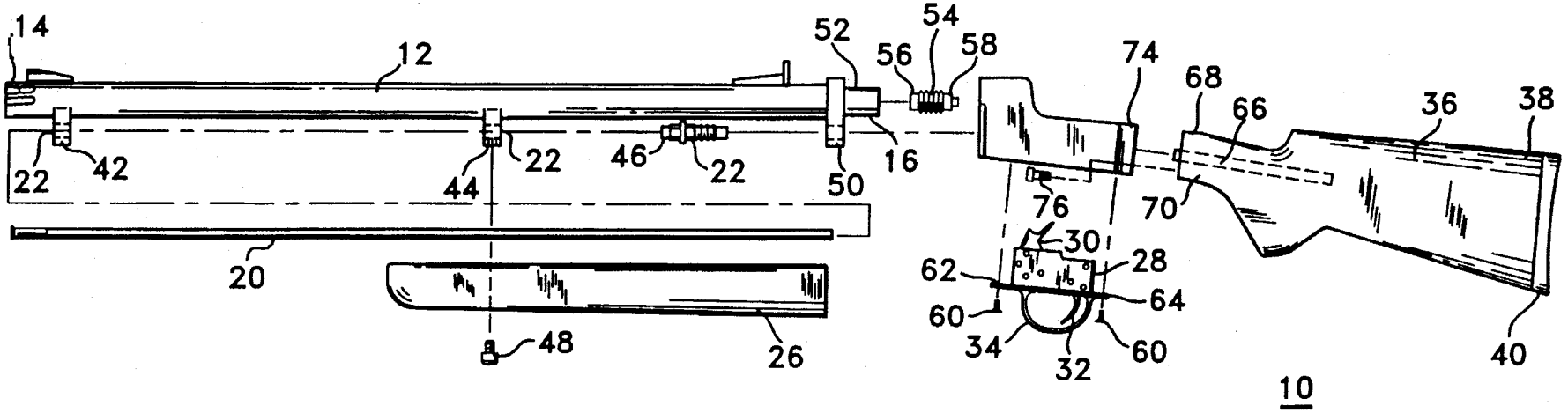
FIG. 2 shows an exploded side view of the firearm.
Figure 4:
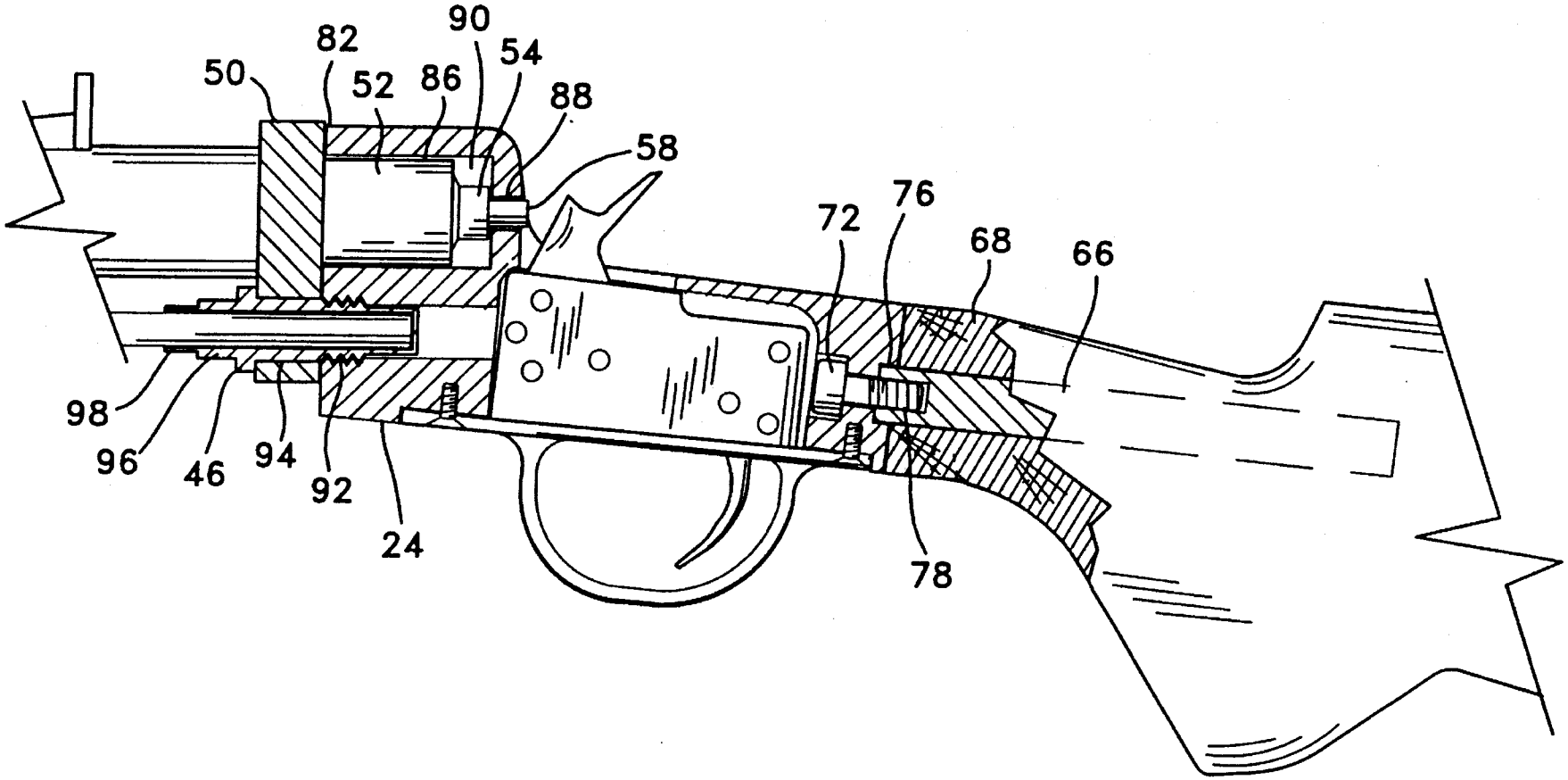
FIG. 4 shows a cross sectional side view of a portion of the firearm where a barrel mates with the receiver.

FIG. 2 shows an exploded side view of firearm 10. As shown in FIG. 2, ramrod carrier 22 includes a muzzle eyelet 42 attached to a bottom side of barrel 12 near muzzle end 14, an intermediate eyelet 44 attached to the bottom side of barrel 12 roughly in the middle region of barrel 12, and a hollow lug bolt 46. Thus, ramrod 20 may be carried by firearm 10 in carrier 22 by being threaded through eyelets 42 and 44 and by being inserted into the hollow portion of lug bolt 46, as best seen in FIG. 4.

Forearm 26 attaches to barrel 12 through a single bolt 48, which is preferably a sling swivel bolt. Bolt 48 passes through a hole (not shown) in forearm 26 and mates with a threaded bore (not shown) in intermediate eyelet 44.

A lug 50 permanently attaches to barrel 12 and extends radially below barrel 12. Lug 50 is used in attaching barrel 12 to receiver 24. In particular, lug bolt 46 secures lug 50 to receiver 24. Desirably, lug 50 resides around one inch away from breech end 16 of barrel 12, and the region between lug 50 and breech end 16 forms a mating section 52 for barrel 12.

A breech plug 54 includes a base section 56 and a nipple 58. Base section 56 is threaded to mate with corresponding threads in breech end 16 of barrel 12. Nipple 58 is dimensioned to accommodate a standard firing cap (not shown). Since breach plug 54 threadably mates with barrel 12, breach plug 54 may be easily removed from barrel 12 using a modest tool, such as wrench. The removal of breach plug 54 from barrel 12 eases the task of cleaning barrel 12 and breach plug 54. A user can easily pass cleaning items, such as rags, pipe cleaners, and the like, entirely through barrel 12 and breach plug 54 because, after removal of breech plug 54, access is provided on opposing sides of bores through each item.

As illustrated in FIG. 2, trigger mechanism 28 is an integral unit which attaches to receiver 24 through two screws 60. Trigger mechanism 28 includes a trigger housing 62 to which hammer 30, trigger 32, and other trigger mechanism 28 components discussed below attach. In the preferred embodiments, trigger guard 34 and a trigger housing base plate 64 are integrally formed with housing 62 as a single piece of steel.

Stock 36 has a metallic insert 66, preferably constructed from steel, which extends from a receiver end 68 of stock 36 toward, but not all the way to, butt end 38. Desirably, insert 66 extends only four to five inches inside stock 36 and is permanently held in place through a suitable adhesive, such as epoxy. This distance causes insert 66 to extend through a narrow wrist section 70 of stock 36. A tip of insert 66 desirably protrudes outside stock 36 a small distance. This tip of insert 66 acts as an alignment stud and provides strength to the attachment joint between stock 36 and receiver 24.

Figure 3:
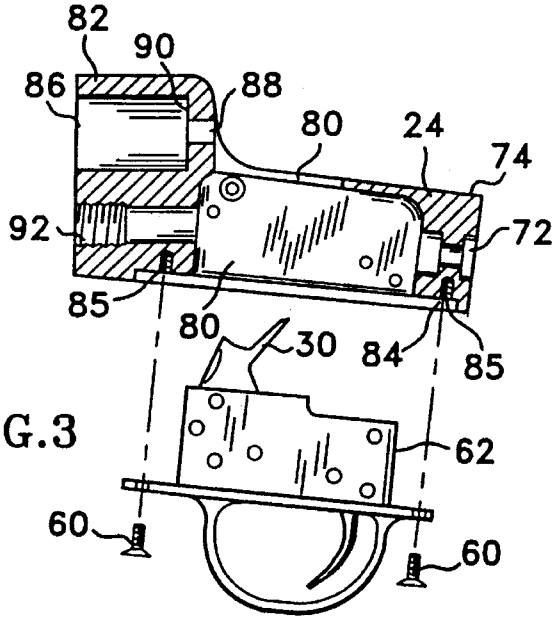
FIG. 3 shows a cross sectional side view of a receiver portion of the firearm.

As best seen in FIG. 3, a bore 72 into receiver 24 from a stock end 74 of receiver 24 accommodates the protruding tip of insert 66. Referring to FIG. 4, a bolt 76 from receiver 24 through bore 72 mates with a threaded bore 78 (that extends axially through a portion of the center of insert 66 from its protruding tip. Although not specifically shown in FIGS. 2–4, receiver end 68 of stock 36 is mortised to accommodate the outline of stock end 74 of receiver 24. Thus, receiver 24 snugly fits into receiver end 68 of stock 36 and is prevented from twisting relative to stock 36 by the mortise.

The joint between receiver 24 and stock 36 is a strong one that enhances the general ruggedness of firearm 10. Since stock 36 attaches to receiver 24 through short bolt 76, which enters through receiver 24, a bore need not be formed entirely through stock 36. This improves the strength of stock 36 and eliminates any need to provide access holes through shoulder pad 40 (see FIG. 1). In addition, the metallic insert 66 adds strength to wrist 70 of stock 36, which would otherwise be the weakest portion of stock 36 due to its small dimensions.

FIG. 3 shows a cross sectional side view of receiver 24. In particular, FIG. 3 illustrates various hollow sections and bores that accommodate barrel 12, lug bolt 46, trigger mechanism 28, and so on. FIG. 4 shows a cross sectional side view of the region of firearm 10 where barrel 12 mates with receiver 24. With reference to FIGS. 2–4, a hollow section 80 extends entirely through receiver 24 from bottom to top. Hollow section 80 is located intermediate stock end 74 of receiver 24 and a barrel end 82 of receiver 24. A mortise section 84 of hollow section 80 accommodates trigger housing base plate 64. Mortise section 84 is located at the bottom side of receiver 24. Proceeding upwards from mortise section 84, hollow section 80 narrows to accommodate the body of trigger housing 62. At the top of receiver 24, hollow section 80 narrows further so that an opening no larger than necessary is provided through which hammer 30 may protrude above receiver 24 (see FIG. 1). In addition, threaded bores 85 extend upward into receiver 24 from mortise section 84. Threaded bores 85 accommodate screws 60.

A barrel bore 86 extending horizontally into receiver 24 from an upper section of barrel end 82 accommodates mating section 52 of barrel 12. Desirably, barrel bore 86 is precisely machined in cooperation with barrel 12 so that a snug but not tight fit results. This enhances the formation of a strong, consistent, square, aligned joint between barrel 12 and receiver 24 while permitting barrel 12 to be easily removed from receiver 24.

Bore 86 includes a bore extension portion 88 which accommodates nipple 58 of breech plug 54. Extension 88 extends roughly a quarter of an inch from a base 90 of barrel bore 86 out to hollow section 80. When breech plug 54 is screwed into barrel 12 and barrel 12 is installed in receiver 24, base 90 resides very near, and may even barely touch, base section 56 of breech plug 54. However, nipple 58 extends through extension 88 out to hollow section 80 where it may be struck by hammer 30. This construction places a firing cap very near breech end 16 of barrel 12 and leads to a relatively short length for firearm 10 given a particular barrel length.

The construction of receiver 24 in the vicinity of base 90 promotes safety for firearm 10. As discussed above, the removable attachment of breech plug 54 to barrel 12 is desirable for cleaning purposes. However, the use of a removable attachment, such as by threaded engagement of breech plug 54 with barrel 12, may slightly increase the risk of this attachment failing. Failure may occur, for example, if firearm 10 is misused. As one possible misuse scenario, firearm 10 may be greatly overcharged, then muzzle end 14 obstructed before igniting the charge. Even if such misuse occurs, receiver 24 provides a significant amount of the material from which receiver 24 is constructed, preferably a firearm-compatible grade of steel, behind breech plug 54. Accordingly, even if severe misuse of firearm 10 causes a failure of this attachment, the chances of breech plug 54 being driven backward to harm a user of firearm 10 are small.

A lug bolt bore 92 also extends roughly horizontally into receiver 24 a length of 1¼ inches or more from barrel end 82. Bore 92 is located in a lower section of receiver 24 and extends from barrel end 82 to hollow section 80. At least an outer section of bore 92 bears threads for removable engagement with lug bolt 46. As discussed in more detail below, the length of bore 92 plays a role for ramrod carrier 22 in holding ramrod 20. In addition, the alignment of bore 2 provides an access hole through which a tool, such as a screwdriver, may be inserted when trigger mechanism 28 has been removed to engage bolt 76 for attaching stock 36 to receiver 24.

Figure 5:
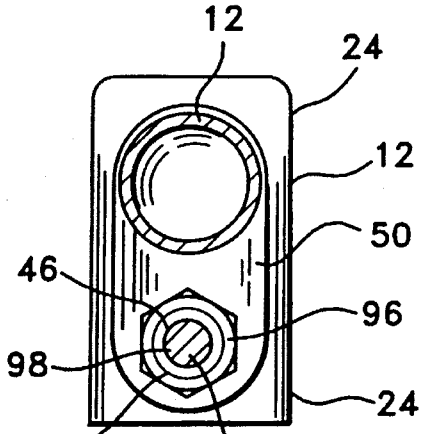
FIG. 5 shows a cross sectional end view of the portion of the firearm where the barrel mates with the receiver.

FIG. 5 shows a cross sectional end view of the region where barrel 12 mates with receiver 24. With reference to FIGS. 4 and 5, lug 50 is cooperatively machined with barrel end 82 of receiver 24 for a flat, parallel alignment. Thus, when barrel 12 is attached to receiver 24, lug 50 abuts receiver 24 at its barrel end 82. A hole 94 through a lower portion of lug 50 extends axially relative to barrel 12 and aligns with bore 92 in receiver 24. Hole 94 is dimensioned to accommodate threaded lug bolt 46. Lug bolt 46 extends through hole 94 and into bore 92 of receiver 24 a significant distance. A flange portion 96 of lug bolt 46 engages lug 50 around hole 94, and a threaded engagement between lug bolt 46 and receiver 24 holds lug 50 firmly in place against receiver 24. Since mating section 52 of barrel 12 fits snugly within barrel bore 86 of receiver 24, barrel 12 is securely, but removably, joined to receiver 24. Lug bolt 46 may be installed or removed using a modest tool, such as a small wrench.

As discussed above in connection with FIG. 2, lug bolt 46 additionally serves a role as a component of ramrod carrier 22. In particular, lug bolt 46 has a bore 98 which extends axially through the center of lug bolt 46 from the flange end of lug bolt 46. Bore 98 is dimensioned so that the end of ramrod 20 fits within it. In particular, since ramrod 20 fits within lug bolt 46 and receiver 24, ramrod 20 may slide within ramrod carrier 22 to a point where a ramming end of ramrod 20 is approximately even with breech end 16 of barrel 12. This allows a handle end of ramrod 20 to be approximately even, and not extend significantly beyond, muzzle end 14 of barrel 12 (see FIG. 1).

Figure 6:
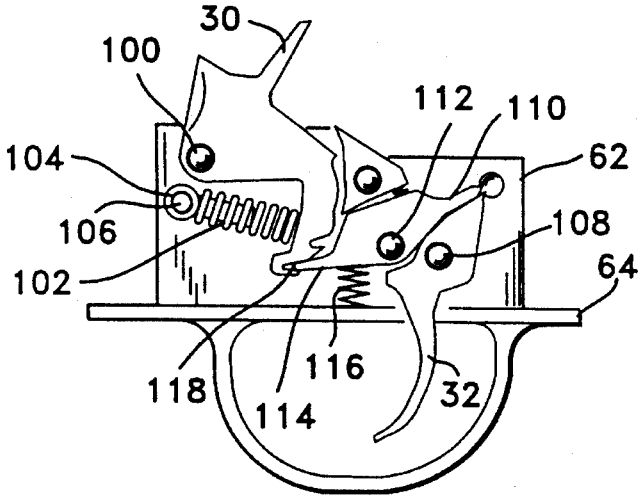
FIG. 6 shows a cross sectional side view of a trigger mechanism in a disassemble position.
Figure 7:
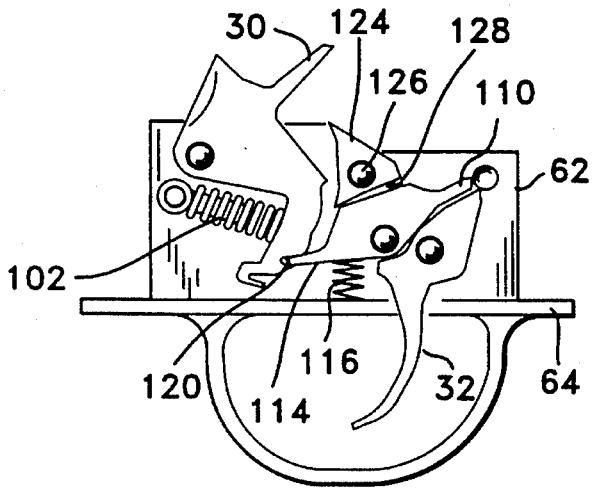
FIG. 7 shows a cross sectional side view of the trigger mechanism in a half-cock position.
Figure 8:
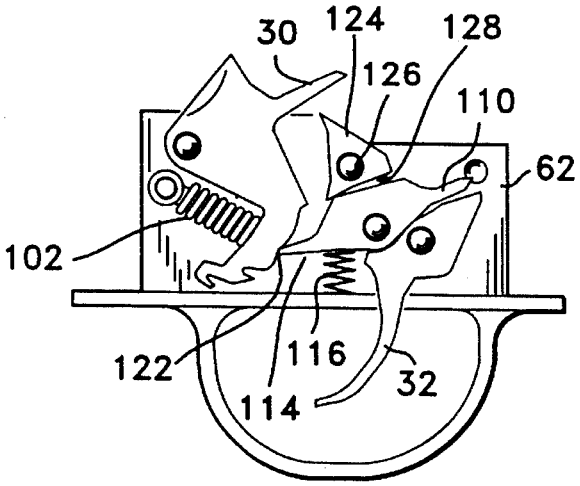
FIG. 8 shows a cross sectional side view of the trigger mechanism in a cocked position.
Figure 9:
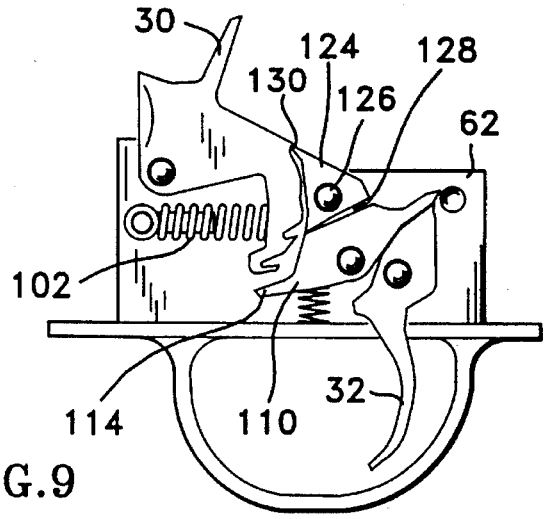
FIG. 9 shows a cross sectional side view of a trigger mechanism in a fired position, with the trigger being pulled.

FIGS. 6–9 describe the operation of trigger mechanism 28. In particular, FIG. 6 shows a cross sectional side view of trigger mechanism 28 in a disassemble position; FIG. 7 shows a cross sectional side view of trigger mechanism 28 in a half-cock position; FIG. 8 shows a cross sectional side view of trigger mechanism 28 in a cocked position; and FIG. 9 shows a cross sectional side view of trigger mechanism 28 in a fired position with trigger 32 being pulled.

Referring to FIGS. 6–9, hammer 30 couples to trigger housing 62 through a pivotal connection at a pivot post 100. Hammer 30 is shaped to extend rearward and downward from post 100. A linear, coil, compression, hammer spring 102 bears against a lower, front portion of hammer 30. A pivot arm 104 fits within spring 102 and pivotally couples to a pivot post 106. Pivot post 106 is displaced from pivot post 100 by being below and in front of post 100. Accordingly, the end of spring 102 that opposes hammer 30 is anchored to housing 62 through a pivotal connection. This pivotal connection is displaced from the pivot point for hammer 30.

This pivotal connection and displacement from hammer pivot post 100 influences the operation of hammer 30. Since spring pivot post 106 is in front of hammer pivot post 100 and since the lower portion of hammer 30 extends rearward from pivot post 100, a relatively strong hammer spring 102 may be used. Spring 102 bears against hammer 30 a short distance below hammer pivot post 100. Consequently, spring 102 needs to move only a short distance to cause hammer 30 to move from its cocked position (see FIG. 8) to its fired position (see FIG. 9). Moreover, spring 102 is free to pivot around post 106 as hammer 30 falls. Since spring 102 needs to move only a short distance and since spring 102 need not expend its energy straightening itself, a quick lock time results. Lock time represents the time between when hammer 30 trips and when ignition takes place. The quick lock time allows firearm 10 to be easier to use because a user need not hold firearm 10 steady for as long after the trigger is pulled.

In addition, the displacement of spring pivot post 106 from hammer pivot post 100 causes the force required to cock hammer 30 to vary throughout its travel. In particular, as hammer 30 is moved from its fired position (see FIG. 9) through its disassemble position (see FIG. 6) and its half-cock position (see FIG. 7) to its cocked position (see FIG. 8), an increasing amount of force is required to overcome the opposite urging force imposed on hammer 30 from spring 102. The increasing amount of force results because the shape of hammer 30 in cooperation with the placement of pivot post 106 causes greater amounts of compression on spring 102 as hammer 30 approaches its cocked position (see FIG. 8).

A smooth and reasonably safe hammer operation results. Since increasing amounts of force are required to place the hammer 30 in its cocked position, hammer 30 is less likely to become cocked accidently. Moreover, users are less encouraged to place their firearms 10 in cocked positions unless they are serious about firing the firearms 10.

With continued reference to FIGS. 6–9, trigger 32 couples to trigger housing 62 through a pivotal attachment at a pivot post 108. When trigger 32 is pulled, an upper portion of trigger 32 moves upward and forward. A sear 110 couples to housing 62 through a pivotal attachment at a pivot post 112. An upper portion of sear 110 abuts the upper portion of trigger 32. Thus, when trigger 32 is pulled, the upper portion of sear 110 also moves upward and forward while a lower end 114 of sear 110 moves downward and backward. A sear linear compression, coil spring 116 bears against lower end 114 of sear 110 and the upper side of trigger housing base plate 64. Thus, lower end 114 of sear 110 is urged upward and forward and the lower portion of trigger 32 is urged forward. Of course, the strength of sear spring 114 is much less than that of hammer spring 102.

When trigger 32 is not being pulled, lower end 114 of sear 110 contacts the lower portion of hammer 30. When hammer 30 is cocked to or placed in the disassemble position (see FIG. 6), lower end 114 fits within a disassembly notch 118 on the lower, back side of hammer 30. Disassembly notch 118 is positioned to move the upper region of hammer 30 a small distance rearward. This small distance allows a hollow portion of hammer 30 to clear nipple 58 (see FIGS. 2 and 4) of breech plug 54. At the same time, hammer 30 is not moved so far rearward that it is obstructed from being removed from receiver 24 (see FIGS. 2–3).

Consequently, with hammer 30 in its disassembly position, trigger mechanism 28 may be removed from and installed into receiver 24 and firearm 10 as a unit through screws 60 (see FIGS. 2 and 4). This unitized trigger mechanism 28 further aids the ease with which firearm 10 may be cleaned. The entire trigger mechanism 28 may be easily removed and cleaned apart from firearm 10.

In addition, disassembly notch 118 is configured to engage lower end 114 of sear 110 so as to prevent trigger 32 from being pulled. In other words, notch 118 is designed to prevent lower end 114 of sear 110 from moving downward and rearward. Thus, disassembly notch 118 serves as a safety for firearm 10.

A half-cock position (see FIG. 7) is the next position as hammer 30 pivots from its fired position toward its cocked position. When hammer 30 is placed in its half-cock position, lower end 114 of sear 110 engages a half-cock notch 120 on the lower, back side of hammer 30. Half-cock notch 120 is positioned to move the upper region of hammer 30 a further distance rearward than the disassembly position. In the half-cock position, room exists between nipple 58 (see FIGS. 2 and 4) of breech plug 54 and hammer 30 so that a firing cap may be installed or removed. In addition, half-cock notch 120 is configured to engage lower end 114 of sear 110 so as to prevent trigger 32 from being pulled. Thus, half-cock notch 120 also serves as a safety for firearm 10.

The cocked position (see FIG. 8) is the final position for hammer 30. When hammer 30 is cocked, lower end 114 of sear 110 engages a cocked notch 122 on the lower, back side of hammer 30. Cocked notch 122 is shaped so that when lower end 114 of sear 110 engages notch 122, hammer 30 is prevented from falling only so long as trigger 32 is not pulled. However, lower end 114 of sear 110 is free to move downward and backward as trigger 32 is pulled. When lower end 114 moves downward and backward, hammer 30 falls. When a firing cap is installed on nipple 58 of breech plug 54, ignition occurs.

When hammer 30 initially trips from a trigger pull, human reaction time is typically so slow that ignition takes place long before a user releases trigger 32. Accordingly, as shown in FIG. 9, for a brief duration at and after ignition, trigger 32 remains pulled while hammer 30 is down. In this situation, an anti-blow-back lever 124 locks hammer 30 in its fired position and prevents blow-back. Lever 124 is a triangular shaped piece that pivotally couples to trigger housing 62 at a pivot post 126. Lever 124 generally resides above the upper portion of sear 110. A small, linear, compression coil spring 128 bears against a rearward portion of lever 124 and the upper portion of sear 110. Spring 128 urges an upper forward side of lever 124 against hammer 30. However, the length of lever 124 away from pivot post 126 is short in both directions. Consequently, lever 124 cannot reach hammer 30 unless the upper portion of sear 110 is first pivoted upward, and the upper portion of sear 110 pivots upward only when trigger 32 is pulled.

When trigger 32 is pulled and hammer 30 is in its fired position, a forward end of lever 124 engages an anti-blow-back notch 130 in the lower back side of hammer 30. This locks hammer 30 in its fired position so long as trigger 32 remains pulled. Detonation gasses from cannot force hammer 30 rearward or escape to a significant extent through nipple 58 (see FIGS. 2 and 4) of breach plug 54. However, as soon as trigger 32 is released, sear 110 pivots out of the way forcing a lower front portion of lever 124 to move upward so that the upper forward portion of lever 124 disengages notch 130. At this point, hammer 30 may again be cocked. During the normal operation of firearm 10, the operation of anti-blow-back lever 124 is transparent to a user. By the time a user pulls and releases trigger 32, detonation has already occurred. As soon as trigger 32 is released, hammer 30 may be manually cocked.

In summary, the present invention provides an improved black powder firearm. A firearm configured in accordance with the teaching of the present invention has an easily removed barrel and trigger mechanism. The convenient disassembly of the present invention makes it exceptionally easy to clean. In addition, the easy barrel removal feature allows the firearm to have interchangeable barrels. The present invention also provides a black powder firearm with enhanced safety characteristics. A removable breech plug is used for ease of cleaning, but this breech plug abuts a steel barrier in the receiver to prevent the breech plug from being driven rearward in the unlikely event of a failure in the attachment of the breech plug. Moreover, a hammer spring is configured so that increasing force is required to move the hammer from its fired position to its cocked position. This makes inadvertent cocking of the hammer less likely. Furthermore, the present invention provides a black powder firearm which incorporates an in-line ignition system that exhibits good reliability, quick lock time, and ease of cleaning. This in-line ignition system is located close to the breech end of the barrel to reduce the firearm's length, and uses a trigger mechanism with an anti-blow-back lever to prevent blow-back. A rugged and reliable firearm results which can withstand a considerable amount of jostling.

The present invention has been described above with reference to preferred embodiments. However, those skilled in the art will recognize that changes and modifications may be made in these preferred embodiments without departing from the scope of the present invention. For example, the preferred embodiment described herein may be characterized as a rifle while the teaching of the present invention may apply other types of firearms, such as hand guns. In such applications, those skilled in the art will readily appreciate that hand grips may be substituted for the stock described herein. Of course, terms used herein such as up, down, horizontal, above, below, upper, lower, front, behind, forward, backward, and the like are relative terms which have meaning to one another. Such terms have been used herein for clarity because they relate to a normal, operational orientation for the firearm and are consistent with orientations shown in the Figures. However, those skilled in the art will appreciate that the firearm may be placed and used in virtually any orientation. These and other changes and modifications which are obvious to those skilled in the art are intended to be included within the scope of the present invention.

What is claimed is:

1. A black powder firearm which accommodates a variety of black powder firearm applications while promoting ease of use, said black powder firearm comprising:

a barrel having a lug located a predetermined distance away from a breech end thereof so that a mating section of said barrel is formed between said lug and said breech end, said mating section having a non-threaded exterior, said lug projecting radially away from said barrel, and said lug having a hole extending axially therethrough relative to said barrel;

a receiver having barrel and stock ends, said receiver also having a first non-threaded bore therein from said barrel end thereof, said first bore being configured to receive said mating section of said barrel, having a second bore therein from said barrel end thereof, said second bore being aligned with said lug hole when said barrel mates with said receiver, and having a hollow section intermediate said barrel and stock ends;

a trigger mechanism configured to reside within said hollow section of said receiver and attach to said receiver; and a stock attached to said receiver at said stock end thereof.

2. A black powder firearm as claimed in claim 1 wherein:

said second bore of said receiver is threaded; and said firearm additionally comprises a lug bolt having a threaded shaft dimensioned to mate with said threaded receiver second bore, said lug bolt serving to removably attach said barrel to said receiver.

3. A black powder firearm as claimed in claim 2 wherein:

said lug bolt has a flange end and a shaft end; and said lug bolt has a lug bolt bore extending axially therein from said flange end.

4. A black powder firearm as claimed in claim 3 additionally comprising a ramrod dimensioned to fit within said lug bolt bore.

5. A black powder firearm as claimed in claim 4 wherein:

said firearm additionally comprises means, coupled to said barrel, for cooperating with said lug bolt bore to form a carrier for said ramrod; and said ramrod is further dimensioned to extend, when installed in said carrier, to approximately a muzzle end of said barrel.

6. A black powder firearm as claimed in claim 1 wherein said trigger mechanism comprises:

a trigger mechanism housing;

a trigger pivotally attached to said housing;

a hammer pivotally attached to said housing;

a trigger guard attached to said housing; and means, coupled to said housing, for removably attaching said housing to said receiver.

7. A black powder firearm as claimed in claim 1 wherein said trigger mechanism comprises:

a hammer configured to pivot about a first pivot point between cocked and fired positions; and a linear hammer spring having a first end which bears against said hammer and a second end, said hammer spring being configured to urge said hammer from said cocked position toward said fired position, and hammer spring second end being positioned relative to said first pivot point to provide increasing urging force as said hammer pivots from said fired position to said cocked position.

8. A black powder firearm as claimed in claim 7 wherein:

said hammer spring pivots about a second pivot point located proximate said second end; and said second pivot point is displaced from said first pivot point.

9. A black powder firearm as claimed in claim 1 wherein said trigger mechanism comprises means for preventing detonation gas blow-back when said firearm is fired.

10. A black powder firearm as claimed in claim 9 wherein:

said trigger mechanism comprises a hammer configured to pivot between cocked and fired positions and a trigger coupled to said hammer to allow said hammer to pivot from said cocked position to said fired position when said trigger is pulled; and said detonation gas blow-back preventing means comprises means coupled to said trigger and said hammer, for locking said hammer in said fired position when said trigger is pulled and said hammer is in said fired position.

11. A black powder firearm as claimed in claim 10 wherein:

said hammer includes a notch; and said locking means comprises a lever having first and second ends on opposing sides of a pivot, said lever first end being actuated by pulling said trigger, and said lever second end being mutually configured with said hammer to engage said hammer notch when said hammer is in said fired position and said lever first end is actuated.

12. A black powder firearm as claimed in claim 1 wherein:

said stock has a butt end and a receiver end, and said stock includes a metallic insert extending partially from said receiver end therein toward said butt end; and said firearm additionally comprises means for attaching said receiver to said metallic insert in said stock.

13. A black powder firearm as claimed in claim 12 wherein:

said metallic insert has a threaded bore; and said attaching means comprises a bolt configured to threadably engage said metal insert at said bore.

14. A black powder firearm as claimed in claim 1 wherein:

said barrel has an axially extending bore which is threaded a predetermined distance into said barrel from said breech end of said barrel;

said firearm additionally comprises a breech plug configured to threadably engage said breech end of said barrel, said breech plug having a nipple configured to support a firing cap; and said receiver first bore having a bore extension hole dimensioned to accommodate said nipple and extending said first bore to said receiver hollow section.

15. A trigger mechanism for a firearm comprising:

a trigger mechanism housing;

a trigger pivotally attached to said housing;

a hammer pivotally attached to said housing;

a trigger guard attached to said housing; and means, coupled to said housing, for engaging said hammer to prevent detonation gas blow-back when said firearm is fired.

16. A trigger mechanism as claimed in claim 15 wherein:

said hammer is configured to pivot about a first pivot point between cocked and fired positions; and said mechanism additionally comprises a linear hammer spring having a first end which bears against said hammer and a second end, said hammer spring being configured to urge said hammer from said cocked position toward said fired position, and hammer spring second end being positioned relative to said first pivot point to provide increasing urging force as said hammer pivots from said fired position to said cocked position.

17. A trigger mechanism as claimed in claim 16 wherein:

said hammer spring pivots about a second pivot point located proximate said second end; and a second pivot point is displaced from said first pivot point.

18. A trigger mechanism as claimed in claim 15 wherein said trigger mechanism additionally comprises means, coupled to said housing, for removably attaching said housing, said trigger, said hammer, and said trigger guard as a unit to said firearm.

19. A trigger mechanism as claimed in claim 18 wherein:

said hammer is configured to pivot between cocked and fired positions and said trigger cooperates with said hammer to allow said hammer to pivot from said cocked position to said fired position when said trigger is pulled; and said detonation gas blow-back preventing means comprises means coupled to said trigger and said hammer, for locking said hammer in said fired position when said trigger is pulled and said hammer is in said fired position.

20. A trigger mechanism as claimed in claim 19 wherein:

said hammer includes a notch; and said locking means comprises a lever having first and second ends on opposing sides of a pivot, said lever first end being actuated by pulling said trigger, and said lever second end being mutually configured with said hammer to engage said hammer notch when said hammer is in said fired position and said lever first end is actuated.

21. A black powder firearm which accommodates a variety of black powder firearm applications while promoting ease of use, said black powder firearm comprising:

a barrel;

a receiver having a barrel end to which said barrel removably attaches, a stock end, and a hollow section intermediate said barrel and stock ends;

a trigger mechanism having a trigger mechanism housing dimensioned to fit within said receiver hollow section, a trigger pivotally attached to said housing, a hammer pivotally attached to said housing, a trigger guard attached to said housing, and means for engaging said hammer to prevent detonation gas blow-back when said firearm is fired; and a stock attached to said receiver at said stock end thereof.

22. A black powder firearm as claimed in claim 21 wherein:

said hammer is configured to pivot about a first pivot point between cocked and fired positions; and said trigger mechanism additionally comprises a linear hammer spring having a first end which bears against said hammer and a second end, said hammer spring being configured to urge said hammer from said cocked position toward said fired position, and hammer spring second end being positioned relative to said first pivot point to provide increasing urging force as said hammer pivots from said fired position to said cocked position.

23. A black powder firearm as claimed in claim 22 wherein:

said hammer spring pivots about a second pivot point located proximate said second end of said hammer spring; and a second pivot point is displaced from said first pivot point.

24. A black powder firearm as claimed in claim 21 wherein said trigger mechanism further comprises means, coupled to said housing, for removably attaching said housing to said receiver.

25. A black powder firearm as claimed in claim 24 wherein:

said hammer is configured to pivot between cocked and fired positions and said trigger cooperates with said hammer to allow said hammer to pivot from said cocked position to said fired position when said trigger is pulled; and said detonation gas blow-back preventing means comprises means, coupled to said trigger and said hammer, for locking said hammer in said fired position when said trigger is pulled and said hammer is in said fired position.

26. A black powder firearm as claimed in claim 25 wherein:

said hammer includes a notch; and said locking means comprises a lever having first and second ends on opposing sides of a pivot, said lever first end being actuated by pulling said trigger, and said lever second end being mutually configured with said hammer to engage said hammer notch when said hammer is in said fired position and said lever first end is actuated.

27. A black powder firearm as claimed in claim 21 wherein:

said stock has a butt end and a receiver end, and said stock includes a metallic insert extending partially from said receiver end therein toward said butt end; and said firearm additionally comprises means for attaching said receiver to said metallic insert in said stock.

28. A black powder firearm as claimed in claim 27 wherein:

said metallic insert has a threaded bore; and said attaching means comprises a bolt configured to threadably engage said metal insert at said bore.

29. A black powder firearm as claimed in claim 21 wherein:

said barrel has an axially extending bore which is threaded a predetermined distance into said barrel from a breech end of said barrel;

said firearm additionally comprises a breech plug configured to threadably engage said breech end of said barrel; and said receiver has a bore formed therein configured to receive said barrel, said bore having a bore extension hole which exhibits a reduced diameter compared to other portions of said bore, said bore extension hole extending said bore to said receiver hollow section.

30. A black powder firearm as claimed in claim 21 wherein:

said barrel has a lug located a predetermined distance away from a breech end thereof so that a mating section of said barrel is formed between said lug and said breech end, said lug projecting radially away from said barrel and said lug having a hole extending axially therethrough relative to said barrel; and said receiver has a first bore therein from said barrel end thereof, said first bore being configured to engage said mating section of said barrel, and a second bore therein from said barrel end thereof, said second bore being aligned with said lug hole when said barrel mates with said receiver.

31. A black powder firearm as claimed in claim 30 wherein:

said second bore of said receiver is threaded; and said firearm additionally comprises a lug bolt having a threaded shaft dimensioned to mate with said threaded receiver second bore, said lug bolt serving to removably attach said barrel to said receiver.

32. A black powder firearm as claimed in claim 31 wherein:

said lug bolt has a flange end and a shaft end; and said lug bolt has a lug bolt bore extending axially therein from said flange end.

33. A black powder firearm as claimed in claim 32 additionally comprising a ramrod dimensioned to fit within said lug bolt bore.

34. A black powder firearm as claimed in claim 33 wherein:

said firearm additionally comprises means, coupled to said barrel, for cooperating with said lug bolt bore to form a carrier for said ramrod; and said ramrod is further dimensioned to extend, when installed in said carrier, to approximately a muzzle end of said barrel.

* * * * *